US005927202A

United States Patent [19]

Hirokawa et al.

[11] Patent Number: 5,927,202

[45] Date of Patent: Jul. 27, 1999

[54] CLAMPING APPARATUS OF A PLATE FOR A PRINTING MACHINE

[75] Inventors: Katsushi Hirokawa; Hiroyuki Sarada, both of Fuchu, Japan

[73] Assignee: Ryobi Ltd., Hiroshima-ken, Japan

[21] Appl. No.: 08/774,428

[22] Filed: Dec. 30, 1996

[30] Foreign Application Priority Data

Jan. 17, 1996 [JP] Japan ..... 8-006119

[51] Int. Cl.[6] ..... B41F 27/12

[52] U.S. Cl. ..... 101/415.1

[58] Field of Search ..... 101/415.1

[56] References Cited

U.S. PATENT DOCUMENTS

| | | | |
|---|---|---|---|
| 3,110,255 | 11/1963 | Jeschke et al. | 101/415.1 |
| 3,168,040 | 2/1965 | Norton | 101/415.1 |
| 3,884,147 | 5/1975 | Abendroth | 101/415.1 |
| 3,946,670 | 3/1976 | Cerny et al. | 101/415.1 |
| 3,976,005 | 8/1976 | Kaufmann | 101/415.1 |
| 4,977,833 | 12/1990 | Inage et al. | 101/415.1 |
| 5,168,810 | 12/1992 | Kojima | 101/415.1 |
| 5,295,435 | 3/1994 | Fuchi | 101/415.1 |
| 5,503,073 | 4/1996 | Bär | 101/415.1 |

FOREIGN PATENT DOCUMENTS

| | | |
|---|---|---|
| 4-70145 | 11/1992 | Japan . |
| 6-5165 | 2/1994 | Japan . |

*Primary Examiner*—Edgar Burr
*Assistant Examiner*—Leslie J. Grohusky
*Attorney, Agent, or Firm*—Merchant & Gould, P.C.

[57] ABSTRACT

A cam shaft 23 is rotated 90 degrees when the plate 10 is fitted on the plate cylinder 60. Thus, as a result of the rotation, a flange part 3T of the tail edge side clamping base 3 is pushed by movement of a spring base 15 which receives a pushing force generated by springs 16. Therefore, the plate 10 is pulled in a tension applying direction. Since the tail edge side clamping base 3 does not receive the limitation of the cam shaft 23 directly, the tail edge side clamping base 3 can be moved in a direction parallel to a shaft of the plate cylinder 60. Thus, a diagonal image adjustment of the plate can be done easily.

10 Claims, 9 Drawing Sheets

CLAMPING APPARATUS OF A PLATE FOR A PRINTING MACHINE

Cross-Reference to Related Applications

This application is based on application Ser. No. Hei8-6119 filed on Jan. 17, 1996 in Japan, the content of which is incorporated hereinto by reference.

BACKGROUND OF THE INVENTION

1. Field of the Invention

The present invention relates to structure of a clamping apparatus of a plate for a printing machine; more specifically, a clamping apparatus of a plate for a printing machine which can carry out diagonal image adjustments easily, as well as pulling a plate with adequate tension, depending on the type of the plate.

2. Description of the Prior Art

As shown in FIG. 6, a plate 10 is rolled on a plate cylinder 60 which is used for offset printing. Offset printing is carried out by supplying both ink and dampening solution to the plate 10. A clamping apparatus is used for fixing the plate 10 on the plate cylinder 60. A cut-out part 61 is formed in the plate cylinder 60, and both a leading edge side clamping base 62 and a tail edge side clamping base 63 are provided in the cut-out part 61.

A leading edge side clamp 64 is located on the leading edge side clamping base 62. A leading edge side part 10*a* of the plate 10 is clamped between the leading edge side clamping base 62 and the leading edge side clamp 64. In the same manner, a tail edge side clamp 65 is located on the tail edge side clamping base 63. A tail edge side part 10*b* of the plate 10 is clamped between the tail edge side clamping base 63 and the tail edge side clamp 65.

In a typical procedure, in order for the plate 10 to fit on a surface of the plate cylinder 60 by applying tension, both the tail edge side clamping base 63 and the tail edge side clamp 65 are moved in a direction shown by arrow 90. A conventional structure of the clamping apparatus of a plate to apply tension to the plate 10 is described as below.

Firstly, the structure of a prior art plate cylinder as disclosed in Japanese Patent Publication No. 70145 of 1992 (Hei 4-70145) is shown in FIG. 7A. As shown in FIG. 7A, the tail edge side 10*b* of the plate 10 is clamped between a tail edge side clamp 75 and a tail edge side clamp base 73 provided in the cut-out part 61. FIG. 7A is a view showing a condition when the plate 10 is not under tension, and as a result is not fit on a surface of the plate cylinder 60.

A plurality of coil springs 70 are provided to engage the tail edge side clamp base 73, whereby the tail edge side clamp base 73 is pushed in the direction of the arrow 90 by the coil springs 70. A direction of expansion and contraction of the coil springs 70 is perpendicular to a shaft of the plate cylinder 60, and the coil springs 70 are arranged in a direction along the shaft of the plate cylinder 60. A plurality of spring adjustment bolts 71 are attached to each of the coil springs 70. The spring force of the coil springs 70 is adjusted by rotating the spring adjustment bolts 71, each of which is threaded and passes through the tail edge side clamp base 73.

A convex part 74 is formed underneath the tail edge side clamp base 73. A circular crank shaft 76 is positioned between a step 78 formed in the cut-out part 61 of the plate cylinder 60 and the convex part 74. The circular crank shaft 76 includes a flat surface 77. In order to apply tension to the plate 10 the circular crank shaft 76 is rotated so that the flat surface 77 faces the convex part 74, with the tail edge side clamp base 73 being moved in the tension applying direction (shown by the arrow 90) by the coil springs 70.

In other words, as shown in FIG. 7B, the plate 10 is fitted on the surface of the plate cylinder 60 as a result of pulling the plate 10 by moving the tail edge side clamp base 73 to a position right beside the flat surface 77 on the circular crank shaft 76, because the tail edge side clamp base 73 is always pushed in a direction shown by the arrow 90 by a strong spring force of the coil springs 70. In this manner, the plate 10 is fitted on the plate cylinder 60.

Another structure of a prior art clamping apparatus of a plate for a printing machine is disclosed in Japanese Patent Publication No. 5165 of 1994 (Hei 6-5165). As shown in FIG. 8A, the tail edge side 10*b* of the plate 10 is clamped between a tail edge side clamp 85 and a tail edge side clamp base 83 provided in the cut-out part 61. FIG. 8A is a view showing a condition when the plate 10 is not under tension, and as a result is not fitted on the surface of the plate cylinder 60.

Both sides of the tail edge side clamp base 83 are supported by brackets (not shown), and a cam 86 is rotatably supported by the brackets. The tail edge side clamp base 83, the tail edge side clamp 85 and the cam 86 are formed as a unit movable in the directions shown by the arrow 90 and the arrow 91.

Additionally, push pins 82 are passed through the tail edge side clamp base 83, and one end of the push pins 82 are in contact with the cam 86. The other end of the push pins 82 are provided with flanges 84 which are engaged by springs 80. The springs 80 are positioned between the flanges 84 and supporting members 88 having a cylinder shaped profile and an "H" shaped section, and the supporting members 88 are in contact with an inner wall 66 of the cut-out part 61. Adjustment screws 81 are provided to adjust the spring force of the springs 80. Adjustment of the spring force is carried out prior to assembly of the parts, because the adjustment can not be done after assembly.

In FIG. 8A, a flat surface 87 of the cam 86 is in contact with the push pins 82. In order to apply tension to the plate 10, the cam 86 is rotated with a tool 89 (FIG. 8B). As a result of the rotation, although the push pins 82 are pushed by the cam 86, the push pins 82 are pushed in the direction shown by the arrow 91 by a spring force of the springs 80.

Therefore, the cam 86 is moved in the direction of the arrow 91 due to its rotation, so that the tail edge side clamp base 83 and the tail edge side clamp 85 are moved in the direction of the arrow 91 with the cam 86 as a unit. Thus, the plate 10 is pulled toward a direction of the arrow 91. As shown in FIG. 8B, the springs 80 are compressed by a pushing force of the cam 86, and the adjustment screws 81 are moved slightly in the direction of the arrow 90. Thus, the plate 10 is fitted on the plate cylinder 60 by applying tension to the plate 10 as described above.

However, conventional structures of the clamping apparatus described above have the following problems to be resolved. Diagonal image adjustment of the plate 10 is carried out after rolling the plate 10 onto the plate cylinder 60 by moving both the tail edge side clamping base 63 and the tail edge side clamp 65, both of which clamp the tail edge side part 10*b* of the plate 10 (see FIG. 6), in a direction parallel to the shaft of the plate cylinder 60.

In the prior art apparatus shown in FIG. 7A and FIG. 7B, the tail edge side clamp base 73 is pushed strongly in the direction of the arrow 90 by the coil springs 70. Therefore, it is not easy to carry out diagonal image adjustment of the plate 10 because of the difficulty of moving the tail edge side clamp base 73 in a direction parallel to the shaft of the plate cylinder, due to a contact pressure generated between the convex part 74 and the circular crank shaft 76.

Referring to the prior art apparatus shown in FIGS. 8A and 8B, not much contact pressure is generated between the cam 86 and the push pins 82 in the configuration shown in FIG. 8A. In other words, no contact pressure is generated between the cam 86 and the push pins 82 because the pushing of the push pins 82 in the direction of the arrow 91 is limited due to contact between the adjustment screws 81 and the supporting members 88. Therefore, diagonal image adjustment of the plate 10 can be easily carried out by moving the tail edge side clamp base 83 in a direction parallel to the shaft of the plate cylinder.

However, the prior art apparatus of FIGS. 8A and 8B has the following problems. Strength of the plate 10 is dependent on the type of the plate. It is preferable to apply adequate tension depending upon the type of the plate 10. In the prior art shown in FIG. 7A and FIG. 7B, the tension to the plate 10 can be adjusted by varying the spring force of the coil springs 70 through rotation of the spring adjustment bolts 71. On the contrary, in the prior art shown in FIG. 8A and FIG. 8B, the tension can not be adjusted after assembly because the adjustment screws 81 are hidden inside of the supporting members 88 and the plate cylinder 60.

Also, it is not possible to vary the tension applied to the plate 10 at various locations along the length thereof because the adjustment screws 81 can not be adjusted. In the first prior art shown in FIG. 7A and FIG. 7B, the spring adjustment bolts 71 are arranged substantially in a direction parallel to the direction of the shaft of the plate cylinder 60. It is therefore possible to apply different tensions to the plate 10 at various positions along the length thereof by adjusting the spring adjustment bolts 71. On the contrary, the prior art shown in FIG. 8A and FIG. 8B can only apply a uniform tension to the plate 10 along the axis of the shaft of the plate cylinder 60.

OBJECTS AND SUMMARY OF THE INVENTION

It is an object of the present invention to provide a clamping apparatus of a plate for a printing machine which can pull the plate with adequate tension, depending upon the type of the plate, as well as easily carrying out diagonal image adjustment of the plate.

In accordance with the present invention, a clamping apparatus of a plate for a printing machine comprises:

a first clamping part provided on the plate cylinder and fixing a first edge of the plate, and a second clamping part provided on the plate cylinder and fixing a second end of the plate, the plate being rolled around a surface of the plate cylinder and the first edge thereof being fixed by the first clamping part, wherein the second clamping part has a holding part which holds the second end of the plate, a pushing part which pushes the holding part so as to move in a tension applying direction to tightly fit the plate with the surface of the plate cylinder, and a pushing force limitation part which limits a pushing force of the pushing part on the holding part and which allows the limitation of the pushing force to be released, and wherein the plate is in a loosened condition with the surface of the plate cylinder by limiting the pushing force of the pushing part on the holding part by the pushing force limitation part, and wherein the plate is in a tensioned, tight fitting condition with the surface of the plate cylinder by releasing the limitation of the pushing force of the pushing part on the holding part by the pushing force limitation part.

While the novel features of the invention are set forth in a general fashion, both as to organization and content, the invention will be better understood and appreciated, along with other objects and features thereof, from the following detailed description taken in conjunction with the drawings.

DESCRIPTION OF THE PREFERRED EMBODIMENT (1) Overall structure

Figure 1:
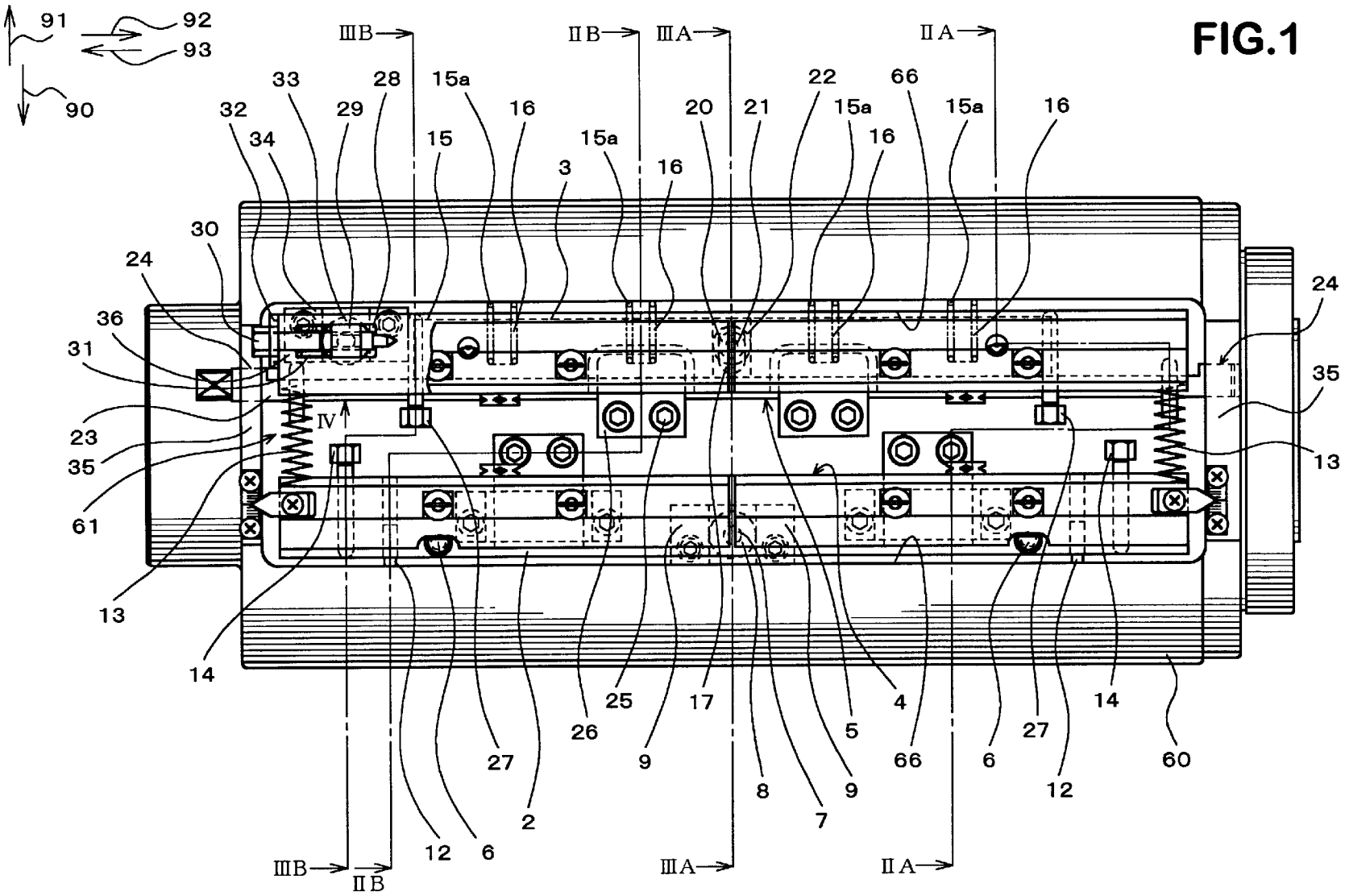
FIG. 1 is a plane view of a plate cylinder showing an embodiment of a clamping apparatus of a plate for a printing machine in accordance with the present invention.
Figure 2A:
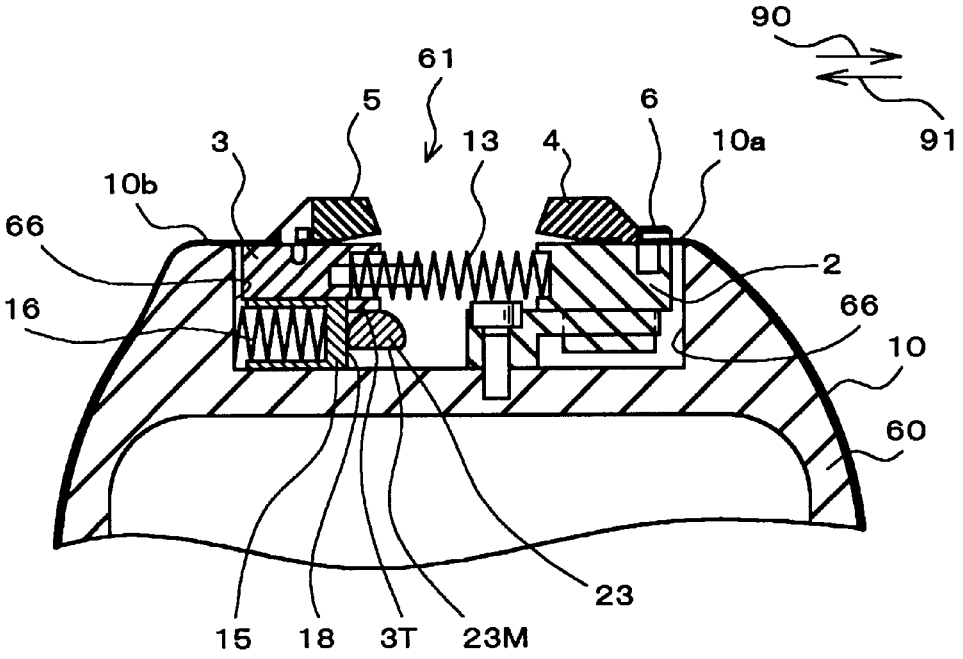
FIG. 2A is a cross sectional view taken along line IIA—IIA of FIG. 1.
Figure 2B:
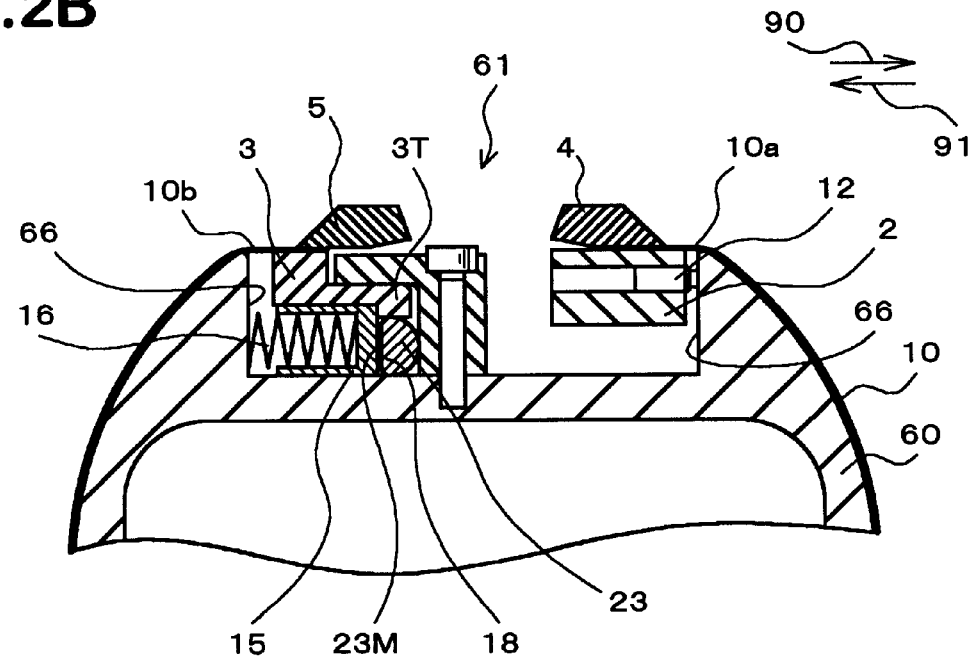
FIG. 2B is a cross sectional view taken along line IIB—IIB of FIG. 1.
Figure 3A:
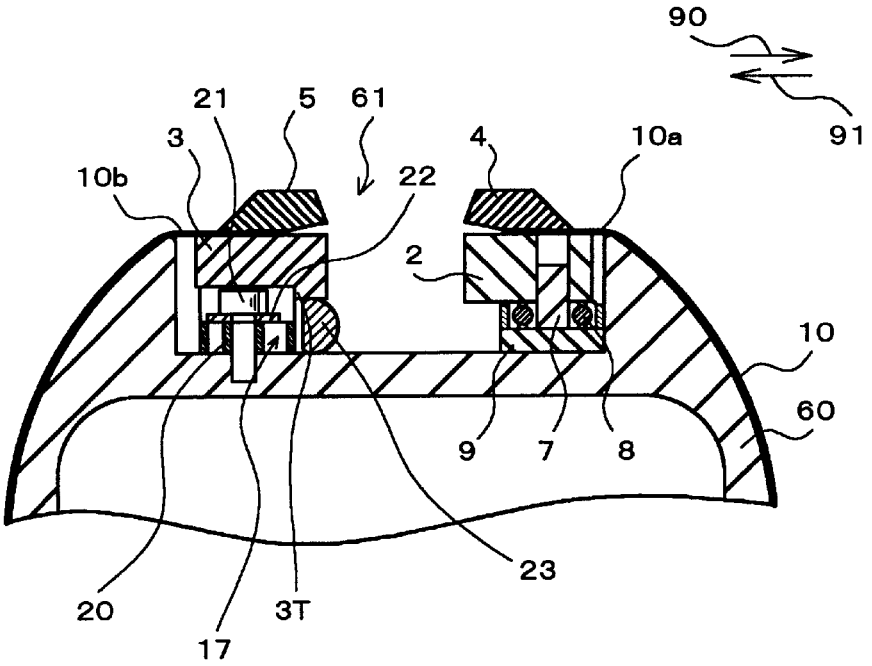
FIG. 3A is a cross sectional view taken along line IIIA—IIIA of FIG. 1.
Figure 3B:
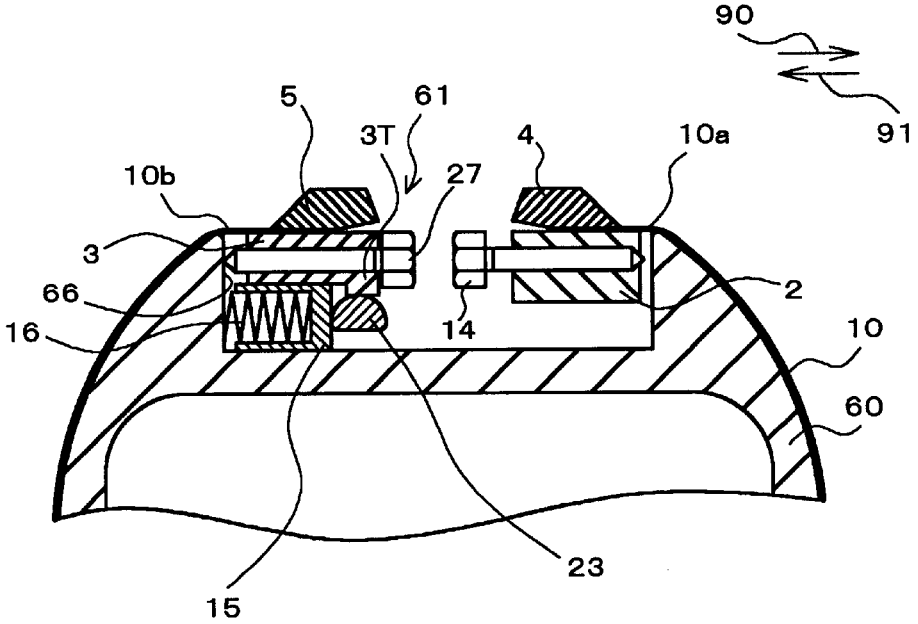
FIG. 3B is a cross sectional view taken along line IIIB—IIIB of FIG. 1.
Figure 4:
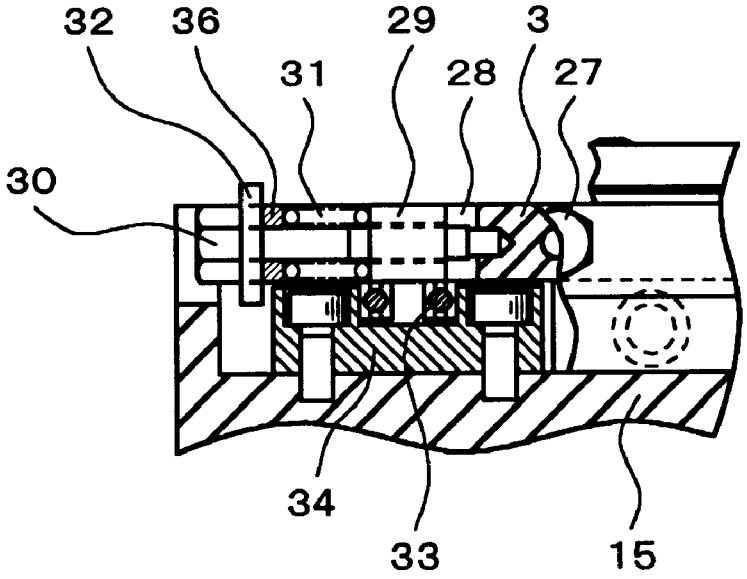
FIG. 4 is a cross sectional view looking in the direction of arrow IV of FIG. 1.
Figure 5:
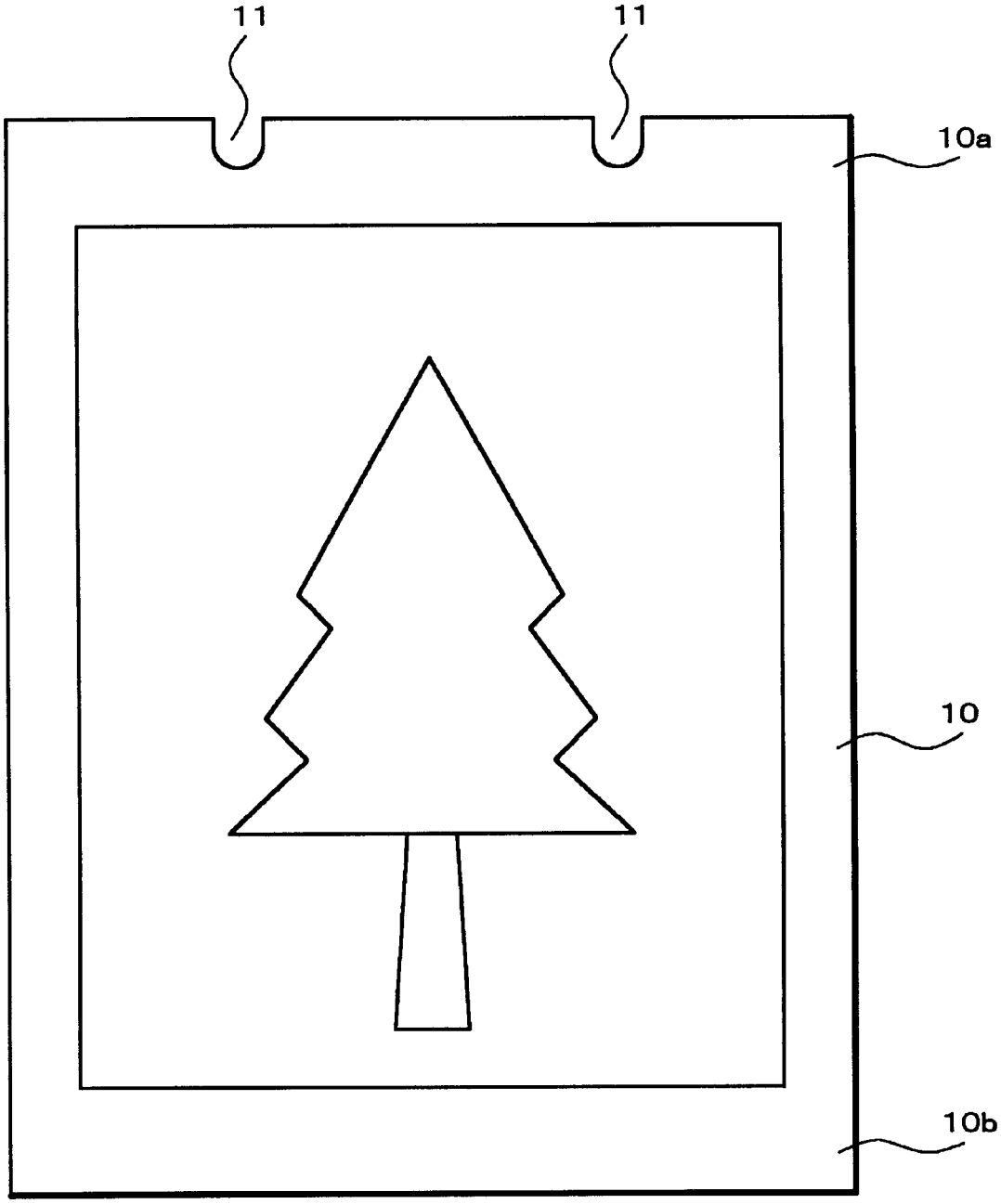
FIG. 5 is a plane view showing the plate.
Figure 6:
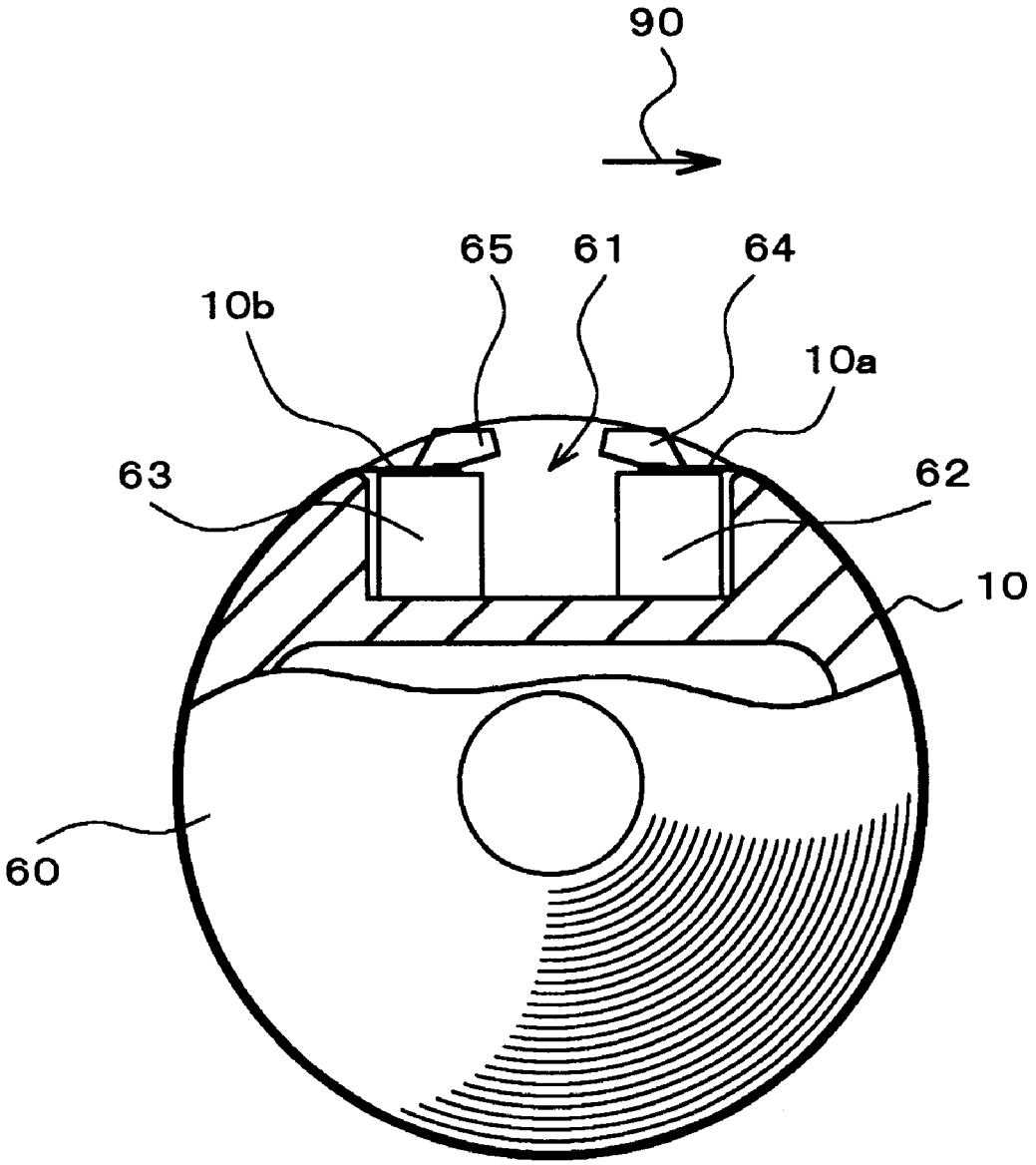
FIG.6 PRIOR ART
FIG. 6 is a side view showing an outline of a prior art plate cylinder.
Figure 7A:
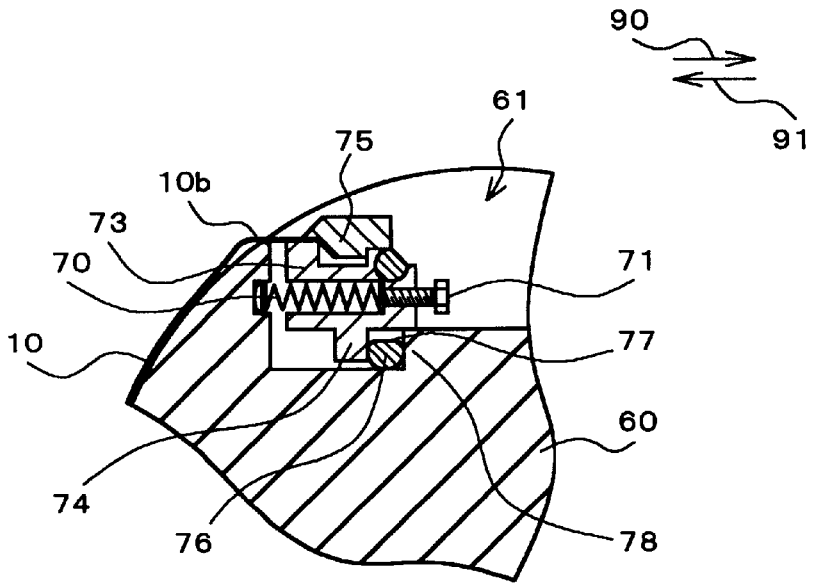
FIG.7A PRIOR ART
FIG. 7A and FIG. 7B are partial views showing a clamping apparatus of the first prior art.
Figure 7B:
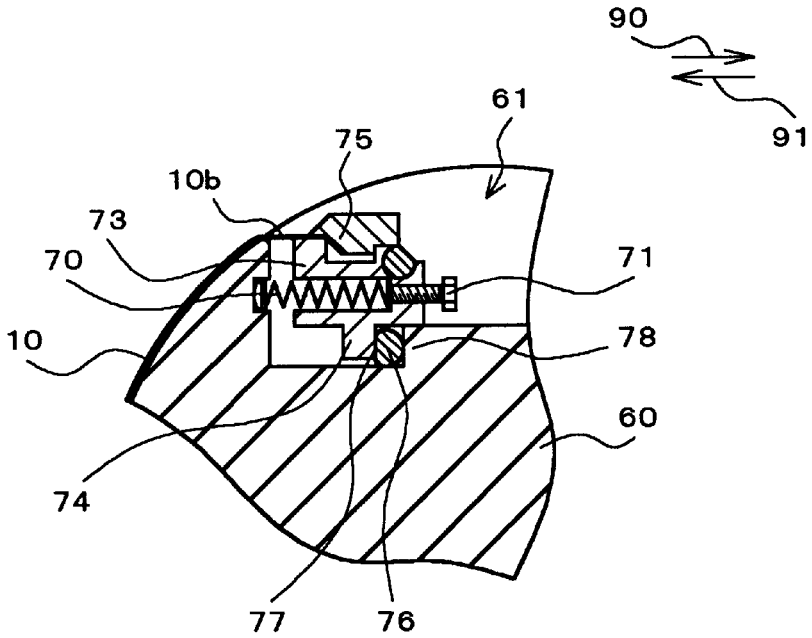
FIG.7B PRIOR ART
Figure 8A:
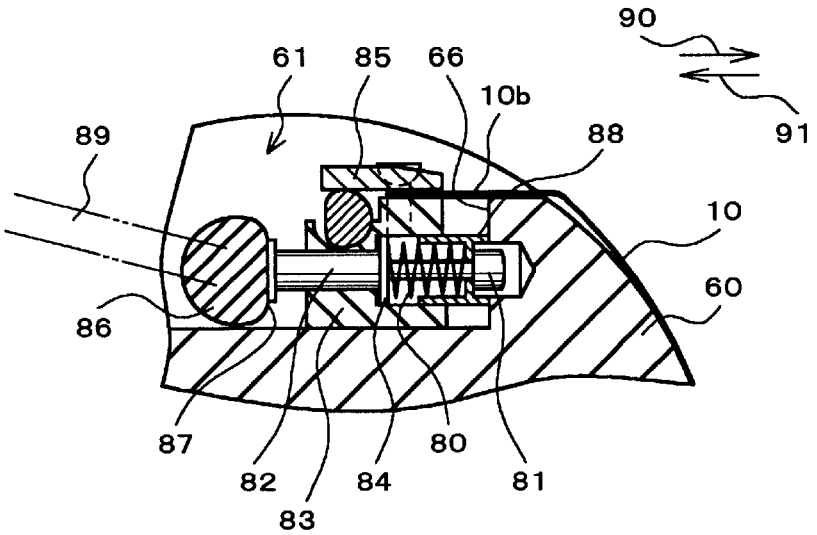
FIG.8A PRIOR ART
FIG. 8A and FIG. 8B are partial views showing a clamping apparatus of the second prior art.
Figure 8B:
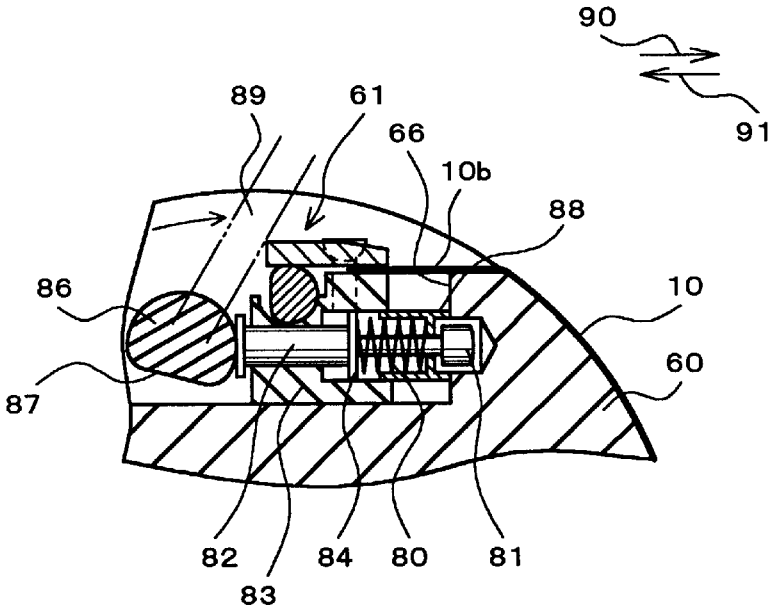
FIG.8B PRIOR ART

An embodiment of a clamping apparatus of a plate for a printing machine in accordance with the present invention will be described with reference to the figures. FIG. 1 is a plane view of a plate cylinder. FIG. 2A and FIG. 2B are cross sectional views taken along lines IIA—IIA and IIB—IIB, respectively, of the apparatus shown in FIG. 1. FIG. 3A and FIG. 3B are cross sectional views taken along lines IIIA—IIIA and IIIB—IIIB, respectively, of the apparatus shown in FIG. 1. Also, FIG. 4 is a cross sectional view in the direction of arrow IV of the apparatus shown in FIG. 1. Further, FIG. 5 shows the plate 10.

A cut-out part 61 is formed on the plate cylinder 60, and both a leading edge side clamping base 2 and a tail edge side clamping, base 3 are provided in the cutout part 61. A leading edge side clamp 4 is provided at a position above the leading edge side clamping base 2. A leading edge side part 10*a* or first edge, of the plate 10 is clamped between the leading edge side clamping base 2 and the leading edge side clamp 4. Both the leading edge side clamping base 2 and the leading edge side clamp 4 form a first clamping part in this embodiment.

Further, a tail edge side clamp 5 is located at a position above the tail edge side clamping base 3. A tail edge side part 10*b*, or second edge, of the plate 10 disposed on the surface of the plate cylinder 60 is clamped between the tail edge side clamping base 3 and the tail edge side clamp 5. Both the tail edge side clamping base 3 and the tail edge side clamp 5 form a holding part in this embodiment.

Springs 13, forming an auxiliary pushing part, are located between the leading edge side clamping base 2 and the tail edge side clamping base 3 (see FIG. 1 and FIG. 2A). The leading edge side clamping base 2 is pushed in the direction of the arrow 90, and the tail edge side clamping base 3 is pushed in the direction of the arrow 91, respectively. The direction of arrow 91 corresponds to a loosened direction in which the plate 10 is loosely disposed or fit on the surface of the plate cylinder 60.

As shown in FIG. 1, two positioning pins 6 are provided on the leading edge side clamping base 2. Positioning of the plate 10 is carried out by engaging positioning slots 11 (FIG. 5) formed at the leading edge side part 10*a* of the plate 10 with the positioning pins 6. The plate 10 is clamped between the leading edge side clamping base 2 and the leading edge side clamp 4 by closing the leading edge side clamp 4. Since the structure for carrying out opening and closing of the leading edge side clamp 4 is well-known, the structure is not described herein.

A bearing 8 is installed at a position below a center part of the leading edge side clamping base 2 using a pin 7. A pair of blocks 9, which form a slot having a width equal to the diameter of the bearing 8, are provided on the bottom of the cut-out part 61 of the plate cylinder 60 (see FIG. 1 and FIG. 3A). The slot is formed between the blocks 9 and extends in the directions of the arrow 90 and the arrow 91. The pin 7 and the bearing 8 are movable in the slot.

As shown in FIG. 1 and FIG. 2B, stopper bolts 12 are screwed into and pass through the leading edge side clamping base 2. The positioning pins 6 inserted into the leading edge side clamping base 2 are positioned at a predetermined position when the stopper bolts 12 contact an inner wall 66 formed in the cut-out part 61 of the plate cylinder 60 as a result of the leading edge side clamping base 2 being pushed in the direction of the arrow 90 by the springs 13, as described above. Adjustment bolts 14 are also provided, which are screwed into and pass through the leading edge side clamping base 2.

The tail edge side clamp 5 located on the tail edge side clamping base 3 has a structure for carrying out opening and closing movements, same as the leading edge side clamp 4. The tail edge side part 10*b* of the plate 10 is clamped between the tail edge side clamping base 3 and the tail edge side clamp 5. Since the structure for carrying out opening and closing of the tail edge side clamp 5 is well-known, the structure is not described herein.

A spring base 15 is located at a position beneath the tail edge side clamping base 3. As shown in FIG. 1, a plurality of holes 15*a* are formed in the spring base 15, and springs 16 are inserted into each of the holes 15*a*. The spring base 15 is pushed in the direction of the arrow 90 by the springs 16. Both the spring base 15 and the springs 16 form a pushing part in this embodiment.

As shown in FIG. 1, a plurality preferably four, of the springs 16 are provided, each of which is expanded and contracted in a direction perpendicular to a shaft of the plate cylinder 60. The springs 16 are arranged in a spaced fashion along the shaft of the plate cylinder 60. Movement of the spring base 15 in the direction of the arrow 90 is limited by contact of the spring base 15 with a cam shaft 23 forming a pushing force limitation part.

The tail edge side clamping base 3 and the tail edge side clamp 5 which form the holding part, the spring base 15 and the springs 16 which form the pushing part, and the cam shaft 23 which forms the pushing force limitation part, together form a second clamping part in this embodiment. The cam shaft 23 is inserted into holes 24 (FIG. 1) formed in side walls 35 of the plate cylinder 60, and the cam shaft 23 can only be rotated in a range of 90 degrees because the rotation thereof is limited by a part (not shown) which limits the rotation of the cam shaft. The cam shaft 23 has a flat surface 23M, and FIG. 2B shows a condition when the cam shaft 23 is rotated 90 degrees from the position shown in FIG. 2A.

Figure 2C:
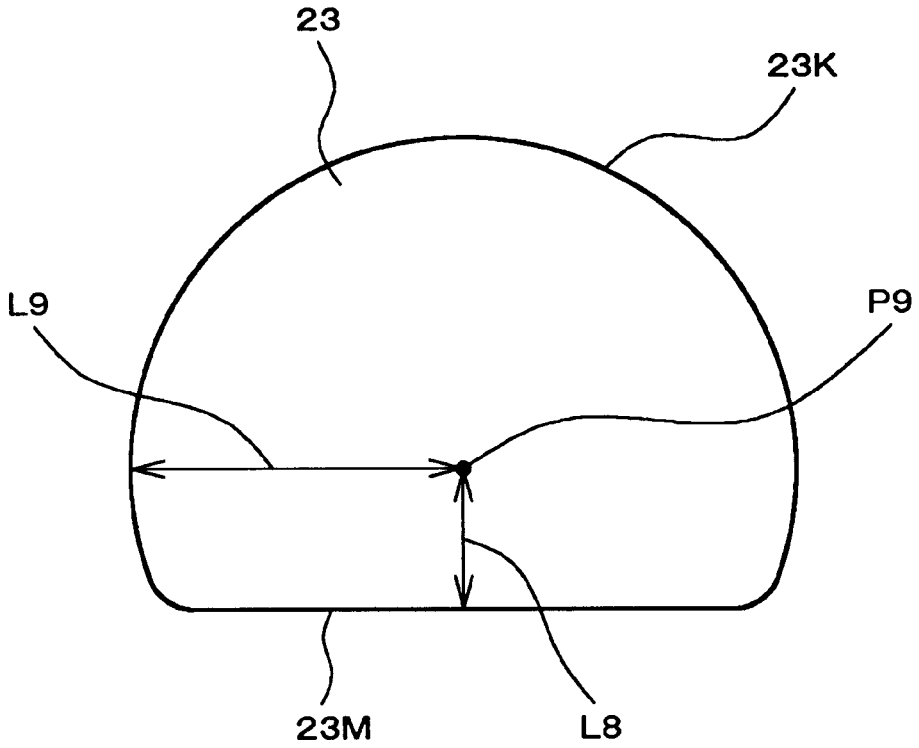
FIG. 2C is an enlarged view showing the cam shaft 23 in FIG. 2A and FIG. 2B.

FIG. 2C is an enlarged view showing the cam shaft 23 of FIG. 2A and FIG. 2B. The cam shaft 23 is rotated about a rotating axis P9. The cam shaft is composed so that a length L8, representing the length between the rotating axis P9 and the flat surface 23M, is shorter than a length L9, which represents the length between the rotating axis P9 and a circumferential surface 23K.

As shown in FIG. 1 and FIG. 3A, a slot 17 is formed in the spring base 15 and extends in the directions of the arrow 90 and the arrow 91. A spacer 20 is fixed at the bottom of the cut-out part 61 of the plate cylinder 60 using a bolt 21 and a washer 22. The spacer 20 is inserted into the slot 17. Therefore, the spring base 15 can only be moved in the directions of the arrow 90 and the arrow 91 with movement of, the spring base 15 in the directions of an arrow 92 and an arrow 93, representing a direction of the shaft of the plate cylinder 60, being prevented (FIG. 1).

The tail edge side clamping base 3 is located on the spring base 15. As shown in FIG. 2A, a flange part 3T is formed on the bottom of the tail edge side clamping base 3. The flange part 3T contacts an end surface 18 of the spring base 15. The tail edge side clamping base 3 is pushed in the direction of the arrow 90 as a result of contact between the flange part 3T and the spring base 15 which receives the spring force of the springs 16. In other words, the tail edge side clamping base 3 is pushed in a tension applying direction to tighten the plate 10 onto the surface of the plate cylinder 60. As a result of pushing the tail edge side clamping base 3 in the direction of the arrow 90, the plate 10 is fitted onto the surface of the plate cylinder 60.

As shown in FIG. 1, raising of the tail edge side clamping base 3 in an upward direction is restricted by blocks 26 fixed to the plate cylinder 60 by bolts 25. In this embodiment, the tail edge side clamping base 3 is held within the cut-out part 61 so as to be moveable in the directions of the arrow 90, the arrow 91, the arrow 92 and the arrow 93. Two tension adjustment bolts 27 are screwed into and pass through the tail edge side clamping base 3. As shown in FIG. 1, a plurality, preferably two, of the tension adjustment bolts 27 are provided, with the tension adjustment bolts 27 being arranged in a spaced manner along the direction of the shaft of the plate cylinder 60.

As shown in FIG. 1 and FIG. 4, a groove 28 is formed at an end of the tail edge side clamping base 3 and extends in the direction of the arrow 92 and the arrow 93. A block 29 is inserted into the groove 28, and the block 29 is movable in the groove 28 in the directions of the arrow 92 and the arrow 93. An adjustment bolt 30 is passed through a side wall 36 of the tail edge side clamping base 3, and the adjustment bolt 30 is screwed into and passes through the block 29.

A spring 31 is disposed around the adjustment bolt 30, and the spring 31 is positioned between the block 29 and the side wall 36. The spring 31 prevents occurrence of backlash of the threads of the adjustment bolt 30 as well as pushing a collar 32 of the adjustment bolt 30 into contact with the tail edge side clamping base 3.

A bearing 33 is inserted onto a pin located at a position beneath the block 29 by compression. A block 34 is fixed at the bottom of the cut-out part 61 of the plate cylinder 60 using bolts. The bearing 33 is inserted into a groove formed in the block 34. The block 29 is therefore moveable along the groove in the directions of the arrow 90 and the arrow 91.

(2) Plate tensioning

Steps to fit or tighten the plate 10 onto the surface of the plate cylinder 60 will be described hereunder. At first, positioning of the plate is carried out by engaging the positioning slots 11 formed at the leading edge side part 10*a* of the plate 10 shown in FIG. 5 with the positioning pins 6 provided on the leading edge side clamping base 2. Then, the plate 10 is clamped between the leading edge side clamping base 2 and the leading edge side clamp 4 by closing the leading edge side clamp 4.

Thereafter, the plate 10 is extended around and onto the surface of the plate cylinder 60, and the tail edge side part 10*b* of the plate 10 is inserted between the tail edge side clamping base 3 and the tail edge side clamp 5. After the insertion, the tail edge side clamp 5 is closed, and the plate 10 is clamped between the tail edge side clamp 5 and the tail edge side clamping base 3. FIG. 2A shows a configuration where the plate 10 is in a loosened condition where the plate 10 is not tightly fit onto the surface of the plate cylinder 60 as a result of contact between the circumferential surface 23K of the cam shaft 23 and the end surface 18 of the spring base 15.

In order to tighten the plate 10 on the plate cylinder 60, the flat surface 23M of the cam shaft 23 is turned so as to face the spring base 15 by rotating the cam shaft 23 90 degrees from the position shown in FIG. 2A (FIG. 2B). Thus, the spring base 15 is moved in the direction of the arrow 90 by releasing the limitation caused by the circumferential surface 23K of the cam shaft 23. In other words, the spring base 15 can be moved in the direction of the arrow 90 over a length calculated by deducting the length L8 from the length L9.

The tail edge side clamping base 3 is also moved in the direction of the arrow 90 due to the engagement between the flange part 3T of the tail edge side clamping base 3 and the spring base 15. Thus, the plate 10 is tightly fitted onto the surface of the plate cylinder 60 as shown in FIG. 2B as a result of pulling the tail edge side part 10*b* in the direction of the arrow 90 (a tension applying condition). In this embodiment, the flat surface 23M of the cam shaft 23 and the end surface 18 of the spring base 15 do not contact each other, because sufficient tension is applied to the plate 10.

As described above, the plate 10 is pulled in accordance with the tension of the springs 16. The tension of the springs 16 is set on the basis of a standard-type plate. Meanwhile, there are various types of plates having different elasticities. Therefore, too much stretch of the plates or loose-fitting of the plates on the surface of the plate cylinder 60 could occur depending upon the elasticity of each plate. Also, springs having a fixed tension cannot be used for a case when the plate 10 is stretched for adjusting a pattern of each color in multi-color printing.

Adjustment of the plate 10 is carried out by the tension adjustment bolts 27 provided on the tail edge side clamping base 3, with the bolts 27 forming the tension adjusting means in this embodiment. FIG. 3B shows a condition when the plate 10 is fitted onto the surface of the plate cylinder 60 by pulling the plate 10 using the tension adjustment bolts 27.

The tail edge side clamping base 3 can be moved in the direction of the arrow 90 by screwing the tension adjustment bolts 27 inward a certain depth, thereby pushing against the inner wall 66 of the cut-out part 61 with the ends of the bolts 27. Therefore, by utilizing the tension adjustment bolts 27, the tail edge side clamping base 3 can be moved independently of the tension of the springs 16. In other words, it is possible to use various plates having different elasticities by pulling the plate 10 with the desired tension. Further, it is possible to apply different tensions to the plate 10 along the length thereof by adjusting the screwing depth of each one of the tension adjustment bolts 27.

(3) Diagonal image adjustment of the plate

As described above, positioning of the plate 10 is carried out by engaging the positioning slots 11 with the positioning pins 6. During the process of fitting the plate 10 onto the surface of the plate cylinder 60, there is a probability that the plate 10 is twisted diagonally. In that case, the plate 10 does not fit completely onto the surface of the plate cylinder 60. Therefore, it is necessary to carry out diagonal image adjustment by moving the tail edge side clamping base 3 in the direction of the shaft of the plate cylinder 60, after clamping the tail edge side part 10*b* of the plate 10 between the tail edge side clamping base 3 and the tail edge side clamp 5. The process of diagonal image adjustment will be described hereunder.

As shown in FIG. 4, diagonal image adjustment is carried out by rotating the adjustment bolt 30 when no tension is applied to the plate 10. In other words, the adjustment bolt 30 is moved in the directions of the arrow 92 and the arrow 93 relative to the block 29 when the adjustment bolt 30 is rotated (see FIG. 1 and FIG. 4) because the adjustment bolt 30 is screwed into the block 29. In this case, the block 29 can be moved along the direction of the groove formed in the block 34 in the directions of the arrow 90 and the arrow 91, but the block can not be moved in the directions of the arrow 92 and the arrow 93.

Thus, it is possible to move the tail edge side clamping base 3 in the directions of the arrow 92 and the arrow 93 in accordance with the rotation of the adjustment bolt 30. For instance, the adjustment bolt 30 is moved in the direction of the arrow 93 relative to the block 29 when the adjustment bolt 30 is rotated in a counter-clockwise direction. As a result, the tail edge side clamping base 3 is moved in the direction of the arrow 93 in response of movement of the adjustment bolt 30 since the tail edge side clamping base 3 is pushed by the spring 31.

On the contrary, the adjustment bolt 30 is moved in the direction of the arrow 92 relative to the block 29 when the adjustment bolt 30 is rotated in a clockwise direction. In this case, the tail edge side clamping base 3 is moved in the direction of the arrow 92 by the rotation of the adjustment bolt 30. Now, the spring 31 is compressed. Thus, it is possible to move the tail edge side clamping base 3 in the directions of the arrow 92 and the arrow 93 for a desired distance. In this embodiment, the tail edge side clamping base 3 can be moved with certain reliability in accordance with a degree of rotation because occurrence of backlash caused by the screw thread of the adjustment bolt 30 is prevented as mentioned earlier. Therefore, a subtle diagonal image adjustment of the plate can be done with accuracy.

A series of steps that are performed for fitting the plate 10 onto the surface of the plate cylinder 60 (hereinafter referred to as plate tensioning) are carried out by pulling the tail edge side clamping base 3 in the direction of the arrow 90 by rotating the cam shaft 23 90 degrees after moving and adjusting the tail edge side clamping base 3 in the directions of the arrow 92 and the arrow 93. In this case, the bearing 33 fixed at a position below the block 29 is moved within the groove formed in the block 34 in the direction of the arrow 90.

Thus, position of the tail edge side clamping base 3 in the directions of the arrow 92 and the arrow 93 is not altered from the correct position by the influence of the plate tensioning. The plate 10 can be fitted on the surface of the plate cylinder 60 with certain reliability by rotating the adjustment bolts 14 provided on the leading edge side clamping base 2, even when the plate 10 is not fitted sufficiently enough on the surface of the plate cylinder 60 by carrying out diagonal image adjustment.

(4) Other embodiments

The tail edge side clamping base 3 and the tail edge side clamp 5, both the spring base 15 and the springs 16, and the cam shaft 23, are used as the holding part, as the pushing part and as the pushing force limitation part respectively in the embodiment described above. The present invention is not limited to the use of these parts, whereby any other structure can be employed which achieves the following functions such that the pushing part pushes the holding part so as to move in the tension applying direction, and the pushing force limitation part limits the pushing force of the pushing part in the tension applying direction.

Further, the tension adjustment bolts 27 are used as the tension adjusting means in the embodiment described above, however the present invention is not limited to use of the bolts as the tension adjustment. Any other structure that achieves the following function such that the holding part is moved and is adjusted in the tension applying direction independent of both the pushing part and the pushing force limitation part.

(5) Advantages of the present invention

In a clamping apparatus of a plate for a printing machine in accordance with the present invention, the second clamping part is composed of the holding part, the pushing part which pushes the holding part so as to move in the tension applying direction, and the pushing force limitation part which limits the pushing force of the pushing part on the holding part and which is actuatable to release the limitation of the pushing force. Either of the loosened condition, where the plate is not tightly fit on the surface of the plate cylinder or the tensioned condition, where the plate is tightly fit on the surface of the plate cylinder, is generated by limiting or releasing the pushing force of the pushing part on the holding part by the pushing force limitation part.

Thus, the holding part is pushed in the tension applying direction by the pushing part, and the pushing force limitation part limits the pushing force of the pushing part in the tension applying direction. In other words, the holding part does not receive the limitation of the pushing force made by the pushing force limitation part directly. Rather, the holding part receives the limitation of the pushing force indirectly in the tension applying direction by limiting the pushing part under control of the pushing force limitation part.

Thus, the holding part can be moved in a direction parallel to a shaft of the plate cylinder without receiving influences caused between the pushing part and the pushing force limitation part. Therefore, a diagonal image adjustment of the plate can be done easily as a result of carrying out movement and adjustment of the holding part in a direction parallel to the shaft of the plate cylinder.

Also, in a clamping apparatus of a plate for a printing machine in accordance with the present invention, a plurality of pushing means are provided, each of which is expanded and contracted in a direction perpendicular to a shaft of the plate cylinder, and the springs are arranged in a direction along the shaft of the plate cylinder. Therefore, the holding part can be moved in the tension applying direction with higher reliability.

Further, in a clamping apparatus of a plate for a printing machine in accordance with the present invention, an auxiliary pushing part is in contact with the holding part and pushes the holding part so as to move in the loosening direction so that the plate is not tightly fit on the surface of the plate cylinder. Therefore the loosened condition where the plate is not tightly fit on the surface of the plate cylinder can be generated with higher reliability as a result of moving the holding part by the auxiliary pushing part in the loosening direction when the pushing force on the holding part is limited by the pushing force limitation part.

Still further, in a clamping apparatus of a plate for a printing machine in accordance with the present invention, a tension adjusting means is provided on the holding part, and the holding part is moved and is adjusted in the tension applying direction by the tension adjusting means which moves and adjusts the holding part independent of both the pushing part and the pushing force limitation part. In other words, the plate can be pulled in the tension applying direction with a tension which is different from the pushing force of the pushing part by moving and adjusting the holding part in the tension applying direction using the tension adjusting means. Therefore, the plate can be pulled with adequate tension depending on the type of plate.

Yet further, in a clamping apparatus of a plate for a printing machine in accordance with the present invention, a plurality of the tension adjusting means are provided on the holding part, and the tension adjusting means are arranged along the direction of the shaft of the plate cylinder, and the holding part is moved and is adjusted in the tension applying direction by the tension adjusting means, each of which moves and adjusts the holding part independent of the others. Therefore, it is possible to apply different tensions to the plate at each of the parts on the plate along the axis of the shaft of the plate cylinder by adjusting the respective tension adjusting means.

While the invention has been described in its preferred embodiments, it is to be understood that the words which have been used are words of description rather than limitation and that changes within the purview of the appended claims may be made without departing from the true scope and spirit of the invention in its broader aspects.

What is claimed is:

1. A clamping apparatus for fixing a plate on a plate cylinder of a printing machine comprising:

a first clamping part mounted on the plate cylinder for fixing a first end of the plate, and a second clamping part mounted on the plate cylinder for fixing a second end of the plate, the plate being disposed around a surface of the plate cylinder and the first end thereof being fixed by the first clamping part, wherein the second clamping part includes a holding part which holds the second end of the plate such that said holding part includes a flange part, a pushing part which pushes the flange part of the holding part so as to move the holding part in a tension applying direction, and a pushing force limitation part which limits a pushing force of the pushing part on the holding part at a first position thereof and the pushing force limitation part being actuatable to a second position where the pushing force of the pushing part on the holding part is not limited by the pushing force limitation part, and wherein the plate is in a loosened condition around the surface of the plate cylinder when the pushing force limitation part is at the first position thereof, and wherein the plate is in a tensioned condition around the surface of the plate cylinder when the pushing force limitation part is at the second position thereof.

2. A clamping apparatus for fixing a plate on a plate cylinder of a printing machine in accordance with claim 1, wherein the pushing part comprises a plurality of springs, each of said springs being expandable and contractable in a direction perpendicular to a shaft of the plate cylinder, and said springs being spaced from each other along a direction parallel to the shaft of the plate cylinder.

3. A clamping apparatus for fixing a plate on a plate cylinder of a printing machine in accordance with claim 1, further comprising:

an auxiliary pushing part in contact with the holding part and pushing the holding part in a direction opposite the tension applying direction.

4. A clamping apparatus for fixing a plate on a plate cylinder of a printing machine in accordance with claim 1, further comprising tension adjusting means provided on the holding part, and wherein the holding part is moveable and adjustable in the tension applying direction by the tension adjusting means.

5. A clamping apparatus for fixing a plate on a plate cylinder of a printing machine in accordance with claim 4, wherein a plurality of said tension adjusting means are provided on the holding part, the plurality of tension adjusting means being spaced from each other along an axis parallel to a shaft of the plate cylinder, and wherein each of the tension adjusting means independently moves and adjusts the holding part.

6. A clamping apparatus for fixing a plate on a plate cylinder of a printing machine in accordance with claim 1, wherein the pushing force limitation part is rotatable between the first and second positions about an axis that is substantially parallel with a shaft of the plate cylinder, and wherein the pushing force limitation part has an external circumferential surface and a flat surface, and wherein the circumferential surface contacts the pushing part when the pushing force limitation part is at the first position, and wherein the flat surface faces the pushing part at the second position of the pushing force limitation part.

7. A clamping apparatus for fixing a plate on a plate cylinder of a printing machine in accordance with claim 6, wherein the pushing part comprises a plurality of springs, each of said springs being expandable and contractable in a direction perpendicular to the shaft of the plate cylinder, and said springs being spaced from each other along a direction parallel to the shaft of the plate cylinder.

8. A clamping apparatus for fixing a plate on a plate cylinder of a printing machine in accordance with claim 6, further comprising:

an auxiliary pushing part in contact with the holding part and pushing the holding part in a direction opposite the tension applying direction.

9. A clamping apparatus for fixing a plate on a plate cylinder of a printing machine in accordance with claim 6, further comprising a tension adjusting means provided on the holding part, and wherein the holding part is moveable and adjustable in the tension applying direction by the tension adjusting means.

10. A clamping apparatus for fixing a plate on a plate cylinder of a printing machine in accordance with claim 9, wherein a plurality of said tension adjusting means are provided on the holding part, the plurality of tension adjusting means being spaced from each other along an axis parallel to the shaft of the plate cylinder, and wherein each of the tension adjusting means independently moves and adjusts the holding part.

* * * * *